US007488863B2

(12) United States Patent
Wylie et al.

(10) Patent No.: US 7,488,863 B2
(45) Date of Patent: Feb. 10, 2009

(54) PROCESS FOR DESTRUCTION OF HALOGENATED ORGANIC COMPOUNDS IN SOLIDS

(75) Inventors: Ian Gordon Norman Wylie, Langley (CA); Nicola Dominelli, Coquitlam (CA); Keith Cheuklap Lee, Vancouver (CA)

(73) Assignee: Powertech Labs, Inc, Surrey, CA (US)

( * ) Notice: Subject to any disclaimer, the term of this patent is extended or adjusted under 35 U.S.C. 154(b) by 0 days.

(21) Appl. No.: 11/823,855

(22) Filed: Jun. 27, 2007

(65) Prior Publication Data

US 2008/0058577 A1 Mar. 6, 2008

Related U.S. Application Data

(63) Continuation of application No. 10/280,996, filed on Oct. 24, 2002, now abandoned.

(60) Provisional application No. 60/337,723, filed on Nov. 7, 2001.

(51) Int. Cl.
*A62D 3/00* (2007.01)

(52) U.S. Cl. ..... 588/406; 588/316

(58) Field of Classification Search ..... 588/313, 588/316, 317, 318, 400, 406
See application file for complete search history.

(56) References Cited

U.S. PATENT DOCUMENTS

| | | | | |
|---|---|---|---|---|
| 4,410,422 | A * | 10/1983 | Brunelle | 588/313 |
| 4,748,292 | A * | 5/1988 | Mendiratta | 585/469 |
| 5,230,140 | A | 7/1993 | Nardella et al. | |
| 6,555,728 | B2 | 4/2003 | Gonzalez et al. | |
| 2003/0036672 | A1 | 2/2003 | Gonzalez et al. | |

FOREIGN PATENT DOCUMENTS

| | | |
|---|---|---|
| CA | 2354938 | 2/2003 |
| DE | 42 06 308 A1 | 2/1992 |
| JP | 62-152479 | 7/1987 |
| JP | 10-118618 | 12/1998 |
| JP | 2003055269 | 2/2003 |

* cited by examiner

*Primary Examiner*—Edward M Johnson
(74) *Attorney, Agent, or Firm*—Jeffrey J. King; Black Lowe Graham PLLC

(57) ABSTRACT

The invention provides processes for decontamination of organic halides in asphalt-containing wastes, such as PCBs in asphaltic potting compounds. The processes may use hydrocarbon solvents to dissolve the asphaltic waste, and an alkali metal reactant, such as a sodium dispersion, to destroy the organic halides in the dissolved mixture.

20 Claims, No Drawings

PROCESS FOR DESTRUCTION OF HALOGENATED ORGANIC COMPOUNDS IN SOLIDS

This is a continuation of the prior application Ser. No. 10/280,996, filed Oct. 24, 2002, now abandoned, and the U.S. Provisional patent application Ser. No. 60/337,723, filed Nov. 7, 2001, the benefit of the filing date of which is hereby claimed under 35 USC 120.

FIELD OF THE INVENTION

The invention is in the field of processes for the destruction of hazardous compounds in solid wastes, particularly the chemical destruction of halogenated organic compounds.

BACKGROUND OF THE INVENTION

A wide variety of halogenated organic compounds have been identified as being potentially hazardous to human health or to the environment. The safe destruction of these compounds in some waste materials is made particularly difficult by the nature of the waste, which may impede access to the hazardous compound for the purpose of treatment. The present invention relates to the treatment of a variety of hazardous halogenated compounds in waste materials comprised of asphalt, an example of which is potting compound contaminated with polychlorinated biphenyls (PCBs).

PCBs are a family of very stable halogenated organic compounds of which there are more than 200 individual compounds (sometimes known as congeners, identified by IUPAC numbers 1-209). PCBs are the product of the chlorination of a biphenyl structure, wherein one or more of the ten hydrogen atoms of a biphenyl are replaced with chlorine atoms.

PCB were often produced in commercial mixtures, such as Aroclors (trademark) sold by the Monsanto Chemical Company. PCBs were often used in mixtures with other halogenated organic compounds, such as trichlorobenzene or tetrachlorobenzene, for example in insulating fluids for electrical equipment (such mixtures may be referred to by the tradename Askarels). In various aspects, the present invention relates to processes for the decomposition of such compounds and mixtures.

PCBs are not easily destroyed by natural processes. Their use has been banned for environmental reasons due to the possible danger to the environment and inhabitants. PCBs are not easily biodegradable and will not disappear or decay to any extent by natural processes. Once they are formed, they can be destroyed only by special and generally expensive procedures.

Because they are stable, conduct heat well and are good electrical insulators while being fire resistant, PCBs have been used extensively in dielectric materials in electrical components such as transformers and capacitors. Although further use of PCBs for such purposes is generally prohibited by regulation in most jurisdictions, large quantities of these chemicals are present in existing equipment or in industrial waste, particularly in the electrical industry. In some jurisdictions, there are very large quantities of wastes in stockpiles awaiting disposal that have been identified as being contaminated with PCBs.

The longstanding nature of the problem of the disposal of organic halides is reflected by the fact that a significant number of innovative methods have been disclosed over a period of many years for disposing of PCBs and other organic halides, as for example are discussed in the following U.S. patents (which are incorporated herein by reference): U.S. Pat. No. 4,284,516 issued 18 Aug. 1981 to Parker et al.; U.S. Pat. No. 4,340,471 issued 20 Jul. 1982 to Jordan; U.S. Pat. No. 4,377,471 issued 22 Mar. 1983 to Brown et al.; U.S. Pat. No. 4,379,752 issued 12 Apr. 1983 to Norman; U.S. Pat. No. 4,379,746 issued 12 Apr. 1983 to Norman; U.S. Pat. No. 4,465,590 issued 14 Aug. 1984 to Adams; U.S. Pat. No. 5,592,844 issued 3 Jun. 1986 to Layman et al.; U.S. Pat. No. 4,636,309 issued 27 Jan. 1987 to Lalancette et al.; and U.S. Pat. No. 5,779,813 issued 14 Jul. 1998 to Plunkett.

While PCBs can be destroyed by incineration, high temperatures and controlled conditions are generally required, in order to avoid generation of PCB thermal decomposition byproducts that may be significantly more toxic than PCBs, such as polychlorinated dioxins and furans. PCBs also have been disposed of by burial, but the stability of these compounds gives rise to concerns about approaches to disposal that do not destroy the compounds themselves.

Capacitors containing PCBs were used in electrical equipment such as fluorescent light ballasts until they were prohibited by regulations. Many of these capacitors leaked PCBs into the ballasts during malfunction, thus contaminating the internal components of the ballast, such as the potting compound. The potting compound is typically a mixture of asphalt and sand (silica) that surrounds the electrical components in the ballast. Potting compounds may also include other ingredients such as waxes that modify properties such as the melt range of the potting compound and the adhesive characteristics of the asphalt. Asphalt is used primarily to provide an adhesive for the sand, which acts as an insulator and heat conductor. Some potting compounds may for example be made up of 35-50% silica for proper heat transfer, 50-65% percent asphalt and 0-10% wax.

The disposal of used PCB-containing electrical components such as capacitors and fluorescent light ballast assemblies has posed a problem to commercial and other institutions for some years, particularly in view of relatively recent regulations governing legal responsibility for their disposal and the environmental safety of the waste products of such disposal. The concomitant problems of enabling conservation or salvaging of the components and materials in the used ballasts by decontamination, reclamation and reuse, refurbishing or recycling of the materials therein (metals, wires and windings, plastics, etc.) have been largely ignored in light of the environmental concerns.

There is a longstanding need for alternative approaches to the decontamination of wastes containing halogenated organic compounds such as PCBs, particularly wastes that may be difficult to treat because they are composed of complex cementitious mixtures entraining the hazardous compounds. In such wastes, the interaction of the hazardous compounds with other compounds in the waste matrix may interfere with the accessibility of the hazardous compounds to treatment.

SUMMARY OF THE INVENTION

In accordance with some aspects of the invention, it has been discovered that it is possible to substantially decontaminate halogenated organic compounds, such as PCBs, in asphaltic wastes, using relatively mild conditions that involve dissolving the compounds in a solvent. In some embodiments, such processes may be made even more efficient by recycling hydrocarbon solvents involved in the processes of the invention. The conditions of treatment may for example be selected to avoid high temperatures that would otherwise lead to the generation of toxic thermal PCB decomposition products, or the evaporative dispersal of the PCBs. Accordingly, in one aspect, the invention provides processes for destruction of PCBs in an asphaltic waste, wherein the processes may comprise steps A, B and C, as follows:

A) Mixing an asphaltic waste, such as a potting compound, entraining a halogenated organic compound, such as a PCB, with a solvent, such as a hydrocarbon solvent, to produce a waste-solvent mixture. The waste, such as potting compound, may for example encase an electrical component, and the electrical component may be treated in the process of the invention with the waste. In some embodiments, for example, potting compound and the electrical components encased by the potting compound may first be separated, and the potting compound and electrical components may each be processed separately.

B) Heating the waste-solvent mixture to a dissolving temperature for a dissolving time to produce a heated waste-solvent mixture in which the asphaltic waste is dissolved in the solvent so that the halogenated organic compound, such as a PCB, is released from the asphaltic waste. In some embodiments, a hydrocarbon solvent may be selected that will facilitate dissolving the asphaltic waste at relatively mild temperatures.

C) Adding a destructive reactant, such as an alkali metal (such as sodium), to the heated waste-solvent mixture at a reaction temperature for a reaction time to produce a treated waste-solvent mixture. The halogenated organic compound, such as a PCB, may be substantially all reacted with the alkali metal reactant to destroy the PCB in the treated waste-solvent mixture. The alkali metal may for example be in an alkali metal dispersion in an alkali metal solvent. In alternative embodiments, the process may include the addition of hydrogen donors or promoters, such as, but not limited to, water, alcohols or acids (as, for example, disclosed in U.S. Pat. No. 5,185,488 to Hawari, European Patent EP0225849 to Burli et al, and Candian Electrical Association Report 153D253, "Scale-up of Chemical Reactions to Destroy Polychlorinated Biphenyls", Dominelli, N and Pugh, D. R., May 17, 1983). In alternative embodiments, a hydrolyzing reactant, such as water, may be added to the treated waste-solvent mixture to hydrolyse an excess amount of the alkali metal remaining in the treated waste-solvent mixture.

In some embodiments, the asphaltic waste may be a solid asphaltic waste with a particular melting temperature. Solid asphaltic wastes containing PCBs may for example be crushed at a crushing temperature that is below the melting temperature of the solid asphaltic waste, for example, at temperatures well below the melting temperature to render the asphaltic material brittle and to facilitate breakage of the asphaltic material. In such embodiments, the crushed waste may be converted to a particulate waste with a relatively high surface area to enhance dissolution in the solvent.

In some embodiments, the dissolving temperature, the reaction temperature and the melting temperature may for example be adjusted to be below the boiling point of the halogenated organic compound, which may for example help avoid evaporative loss of hazardous compounds such as PCBs during the processes of the invention.

In one aspect, the treated waste-solvent mixture may be distilled to separate the solvent, such as a hydrocarbon solvent, from the asphaltic waste, for example to produce a recyclable hydrocarbon solvent. The distillation conditions may be adjusted, for example, so that the recyclable solvent may be substantially free of asphalt. The recyclable solvent may in turn be reused as the solvent in the step of mixing with the asphaltic waste to produce the waste-solvent mixture.

In various embodiments of the invention, an asphaltic waste is a waste material comprised of a substantial portion of asphalt, in which, for the purposes of the processes of the invention, halogenated organic compounds may be entrained by the cementitious nature of the asphalt. In accordance with the general understanding in the art, asphalt generally includes bituminous substances derived as residua in refining from natural sources such as petroleum, shale oil, coal tar and pitches. Asphalts are typically mixtures of hydrocarbons of natural and/or pyrogenous origin, accompanied by their derivatives, often prepared by distillation of crude oil. As such, asphalt is a mixture of paraffinic and aromatic hydrocarbons and heterocyclic compounds containing sulfur, nitrogen and oxygen. Asphalt is a cementitious material having a solid or semi-solid consistency.

Halogenated organic compounds that may be treated in accordance with alternative aspects of the invention include aromatic and non-aromatic halides (bromides, chlorides, fluorides and iodides). Representative halogenated organic compounds include PCBs and dioxins. In some embodiments, the invention is restricted to the destruction of PCBs.

In some aspects of the present invention there are provided processes for decontamination of electrical components encased in asphaltic compositions, comprising the steps of: crushing the electrical components to form crushed fragments; adding a solvent to the crushed fragments to form a mixture; heating the mixture to a reaction temperature that is sufficient to dissolve the asphaltic material and thereby release the hazardous compounds from it; and reacting the mixture with a compound, such as an alkali metal dispersion, for a period of time sufficient to reduce the amount of the hazardous material in the waste mixture.

In accordance with some embodiments of the invention there is provided a process for decontamination of hazardous compounds, such as halogenated organic compounds (including PCBs) found in electrical light ballasts, where the light ballasts are composed of asphaltic potting compound and electrical components. Such processes of the invention may for example comprise the steps of: crushing the light ballasts to form crushed fragments; adding a solvent to the crushed fragments to form a mixture; heating the mixture to a reaction temperature that is sufficient to dissolve the potting compound; reacting the mixture with a reactant, such as an alkali metal dispersion, for a period of time sufficient to reduce the amount of the hazardous compound in the mixture.

In alternative aspects, the invention provides an apparatus with means for carrying out the steps of the processes of the invention, such as:

a) means for mixing an asphaltic waste entraining an organic halide with a solvent to produce a waste-solvent mixture;

b) means for heating the waste-solvent mixture to a dissolving temperature for a dissolving time to produce a heated waste-solvent mixture in which the asphaltic waste is dissolved in the solvent so that the organic halide is released from the asphaltic waste;

c) means for adding a destructive reactant to the heated waste-solvent mixture at a reaction temperature for a reaction time to produce a treated waste-solvent mixture in which the organic halide is substantially all reacted with the destructive reactant to destroy the organic halide.

The apparatus of the invention may include automated controls to adapt standard material handling equipment to carry out the processes of the invention in an automated fashion. Such controls may for example adapt a mixer with a heating element and timer for mixing the waste with the solvent at the dissolving temperature for the dissolving time.

The controls may also adapt the mixer or a reaction vessel for reacting the heated waste-solvent mixture at the reaction temperature for the reaction time to produce the treated waste-solvent mixture.

DETAILED DESCRIPTION OF EMBODIMENTS OF THE INVENTION

In some aspects, the invention provides relatively mild processes for decontaminating electrical components using organic solvents. Processes of the invention are disclosed that have surprisingly been found capable of dissolving asphaltic wastes to an extent that renders hazardous compounds, such as PCBs, amenable to destructive chemical treatment. The electrical components may for example be capacitor windings entrained in an asphaltic potting compound, as may be found in fluorescent light ballasts. Processes for treating asphaltic wastes may involve heating the waste in the solvent and reacting the dissolved material with a reactant, such as an alkali metal in an organic solvent dispersion. In some embodiments, it has surprisingly been discovered that even a complex mixture of asphaltic waste derived from potting compounds, when dissolved in selected solvents, may be treated to substantially destroy all PCB contaminants (at temperatures below the boiling point of the PCBs in preferred embodiments).

In this context, to "substantially destroy" a hazardous compound, such as a PCB, means that the concentration of the hazardous compound is reduced to a level at which it is not hazardous or toxic. In some embodiments, for example, there may be regulatory limits on the concentration of PCBs in waste materials, and the processes of the invention may accordingly be used to reduce the concentration of PCBs in wastes to levels that are below the regulatory limits. In some embodiments, concentrations of hazardous compounds such as PCBs may for example be reduced in treated wastes to levels below about 100ppm, 90ppm, 80ppm, 70ppm, 60ppm, 50ppm, 40ppm, 30ppm, 20ppm, 10ppm, 5ppm, 2ppm, 1ppm, or 0.5ppm. In alternative embodiments, the waste to be treated may for example initially contain hazardous compounds such as PCBs at concentrations greater than the following values: about 100ppm, 200ppm, 300ppm, 400ppm, 500ppm, 1000ppm, 2000ppm, 3000ppm, 4000ppm, 5000ppm, 6000ppm, 7000ppm, 8000ppm, 9000ppm, 10,000ppm, 100,000ppm or 200,000ppm (or any value between 100ppm and 200,000ppm). Alternative embodiments of the invention may for example involve treating waste having a hazardous compound concentration greater than any one of the forgoing initial values, so that the treated waste has a hazardous compound concentration below any one of the foregoing treated waste values. Such treatments may for example be characterized as destroying a certain percentage of the hazardous compound, such as 80%, 90%, 95%, 99%, 99.9% or 99.99%.

In some embodiments of the present invention, fluorescent light ballasts may be separated into potting compound (composed mainly of asphalt and sand) and capacitor windings. The potting compound and electrical components, for example the capacitor windings, may be handled separately by the processes of the present invention, or the potting compound and the electrical components may be processed together. Segregation of waste streams may increase the available options for disposal of the products of the processes of the present invention, including the possibility of recycling.

Separation of potting compound from electrical components in a fluorescent light ballast may for example be carried out by manual or automated processes. For example, an asphaltic potting compound may be subjected to impact forces to promote the cracking of the potting compound, and thus the separation of the potting compound from the internal electrical components. Method are for example disclosed in U.S. Pat. No. 5,230,140 (incorporated herein by reference) involving the cryogenic freezing of potting compound to the extent that the frozen potting compound becomes sufficiently brittle to enable it to be pulverized into small pieces that may be separated relatively cleanly away from the internal electrical components.

Wastes to be treated, such as potting compounds, may be crushed. In some embodiments, the crushed waste may for example have a preferred particle size, such as an average particle size of less than approximately 2 inches (5 cm), 1 inch (2.5 cm) or ½ inch (1.25 cm) in size. The process of separating a potting compound from electrical components may be adapted to yield potting compound fragments within the aforementioned particles size ranges, or additional steps of crushing the potting compound may be carried out. Waste particle size reduction may for example be accomplished by processing the waste through an appropriate grinder for size reduction. A grinding or crushing process may be selected so that it will refine the waste without melting it. In particular embodiments, a rotary shaft grinder design with a horizontal ram feed may be preferred where it minimizes cutting friction and heat build-up. Waste, such as crushed potting compound, may be loaded into a reaction vessel such as a mixer/evaporator, to which is added a solvent. In particular embodiments, a horizontal mixer of the plough design may be used because where it disperses materials more efficiently than a ribbon or blade type mixer.

The solvent for dissolving the asphaltic waste may be chosen such that its boiling point is higher than the reaction temperature, such as by being approximately 5° C. to 10° C. higher than the reaction temperature. In some embodiments, reaction temperatures may for example be between 100° C. to 170° C. (as described below), so that in some embodiments a solvent may be selected with a boiling point of at least about 105° C. to at least about 180° C. (or any value in that range). Using a solvent having an appropriate boiling point may reduce solvent evaporation during reaction with the waste, and may facilitate a more efficient recovery of the solvent by distillation at the end of the process, if desired. As well, the solvent is preferably chosen to be of a type that does not react with the reactant, such as solvents that do not react under the reaction conditions with an alkali metal.

In various embodiments, suitable solvents for the processes of the invention may include mineral spirits, aliphatic hydrocarbons, paraffin oils, insulating oils or transformer oils. Examples of suitable hydrocarbon solvents in some embodiments include VARSOL™ or ISOPAR K™ solvent (manufactured by Exxon Mobil Corporation). Preferred solvents are low polarity liquids, such as hydrocarbon solvents, and preferred hydrocarbon solvents are oils. As used herein, the term solvent includes any substance which is a liquid at the dissolving temperature and the reaction temperature, and which is capable of dissolving the asphaltic waste and serving as a medium in which the organic halogen compound may be destroyed.

In some embodiments, the waste-solvent mixture may be heated, for example in a mixer, to a temperature of between about 100° C. to about 170° C. until the asphaltic waste (such as potting compound) dissolves, thereby releasing the hazardous compounds (such as PCBs) into solution. The temperature may be maintained at a selected reaction temperature throughout the reaction, or modulated over time. During the process, the oxygen content in the reaction vessel may be maintained below a flammability limit of the solvent, to increase the safety of the process. An inert gas atmosphere may be applied to increase safety. In some embodiments, the oxygen content of the atmosphere in a reaction vessel may be maintained below about 10%, 9%, 8%, 7% or preferably 6% at all times during the step of dissolving the waste, and less than about 5%, 4%, 3% or preferably below 2.5% when an alkali metal reactant is present, such as a sodium dispersion.

In various embodiments, an alkali metal, which may be, for example, a dispersion of sodium in a solvent, is added to the reaction mixture, and allowed to react with the halogenated organic compound for a period of time, for example 30-60 minutes. More or less time may be required depending in part on the amount of organic halide present in the starting material. Sodium dispersions are generally commercially available. As well, there are a number of processes for the production of suitable sodium dispersions that are known. It may be preferable that a solvent used in the alkali metal dispersion have a boiling point similar to the solvent used to dissolve the asphaltic waste, and may in some embodiments be the same as the solvent used to dissolve the asphaltic waste. Alkali metal solvents may for example be selected from the following non-exhaustive list: mineral oils, paraffinic oils, insulating oils, or transformer oils. In alternative embodiments, the particle size of the alkali metal dispersion may be less than about 100 microns, 50 microns, 40 microns, 30 microns, 20 microns, 10 microns or 5 microns.

Alternative PCB destruction processes, such as, for example, base-catalysed decomposition processes or alkali metal hydroxide based decomposition processes may be used in combination with the present invention (as, for example, disclosed in U.S. Pat. No. 4,477,354 to Fessler, U.S. Pat. No. 5,064,526 to Rogers et al., U.S. Pat. No. 4,460,797 to Pytlewski et al., or U.S. Pat. No. 4,471,143 to Pytlewski et al.). In some embodiments, alternative alkali metals may be used, such as potassium.

After the reaction has been allowed to proceed for a period of time, excess alkali metal in the reaction mixture may be hydrolysed and neutralized, for example with the injection of water and carbon dioxide into the mixer. Hydrogen formed during this stage of the process may be captured for later use or it may be allowed to exhaust to the environment after passing through an appropriate exhaust filter, the purpose of which is to trap any liquid and solids that may be carried with the gas stream.

The solvent may be recovered for reuse, for example by distillation. Distillation may be first carried out at atmospheric pressure or at reduced pressures. In some embodiments, the distillation pressure may be reduced during distillation to facilitate a near complete recovery of the solvent. A decontaminated treated asphaltic waste product may be kept molten, for example by keeping potting compound at a temperature above the melting point of the compound, such as 120-170° C. Treated asphaltic waste may be discharged from the reaction vessel into a collection bin.

In some embodiments, electrical components, such as capacitor windings obtained from a fluorescent light ballast, may be processed in a manner similar to that described above for asphaltic wastes. This may, for example, be advantageous when the components have asphaltic material still associated with them. In such embodiments, the reaction temperature may for example be in the approximate range of 150° C. to 170° C. Decontaminated electrical components may be discharged from a reaction vessel as a solid.

The following examples illustrate aspects of the invention, and are not exhaustive and do not limit the scope thereof.

EXAMPLE 1

All PCB analyses in the examples were performed with a HP5890 gas chromatograph equipped with a 0.53 mm by 15 m DB5 wide bore capillary column and an electron capture detector. The ASTM D4059 method, which has a detection limit of 2 mg/kg PCB, was used. Alternative testing methods may be used, such as alternative methods published from time to time by the American Society For Testing and Materials (ASTM), the United States Environmental Protection Agency (EPA), or other organization in government or industry.

Potting compound from a PCB contaminated fluorescent light ballast was separated from the other components and crushed as described above until the average particle size of the potting compound was less than ½" in size. 200 g of the crushed potting compound was placed into a 750 mL glass reaction vessel fitted with a water cooled condenser, an inlet for nitrogen gas and an inlet for a dropping funnel. 200 g of the solvent ISOPAR K™ was placed into the reaction vessel, and the mixture was agitated using a variable speed mechanical stirrer. The mixture in the reaction vessel was heated to a reaction temperature of approximately 120° C. under a nitrogen atmosphere. A sample of the mixture was removed and the concentration of PCBs in the sample was measured to be 290 mg/kg (equivalent to 490 mg/kg in the feed material). 20 g of sodium dispersion (20% by weight of sodium in insulating oil) was added to the mixture and allowed to react with the mixture while the temperature of the mixture was maintained near 120° C. Another sample of the mixture was removed after approximately 30 minutes and again at 80 minutes after the addition of the sodium dispersion, and the concentration of PCBs in each case was measured to be below the detection limit. The mixture was then allowed to cool, and at below 100° C., 11 g of water was added to the mixture to hydrolyse any remaining sodium.

EXAMPLE 2

Capacitor windings from a PCB contaminated fluorescent light ballast was separated from the other components and crushed as described above until the average particle size of the capacitor windings was less than ½" in size. 30 g of the crushed capacitor windings and 550 g of the solvent ISOPAR K™ were placed into a 750 mL glass reaction vessel fitted with a water cooled condenser, an inlet for nitrogen gas and an inlet for a dropping funnel, and the mixture was agitated using a variable speed mechanical stirrer. The mixture in the reaction vessel was heated to a reaction temperature of approximately 170° C. under a nitrogen atmosphere. A sample of the mixture was removed and the concentration of PCBs in the sample was measured to be 9,660 mg/kg (equivalent to 17.9% PCB in the feed material). 30 g of sodium dispersion (20% by weight of sodium in insulating oil) was added to the mixture and allowed to react with the mixture while the temperature of the mixture was maintained near 170° C. Another sample of the mixture was removed after approximately 30 minutes and again at 90 minutes after the addition of the sodium dispersion, and the concentration of PCBs in each case was measured to be below the detection limit. The mixture was then allowed to cool, and at below 100° C., 11 g of water was added to the mixture.

In some embodiments of the present invention, the potting compound and the internal electrical components from fluorescent light ballasts may be crushed simultaneously into the preferred particle sizes and processed together. The crushed potting compound and electrical components may then be loaded into the reaction vessel to which is added the solvent, and the same general steps as described above may be carried out.

EXAMPLE 3

80 g of crushed potting compound and 20 g of crushed capacitor windings, having average particle sizes of less than ½" in size, were placed into a 750 mL glass reaction vessel fitted with a water cooled condenser, an inlet for nitrogen gas and an inlet for a dropping funnel. 390 g of the solvent VARSOL™ was placed into the reaction vessel, and the mixture was agitated using a variable speed mechanical stirrer. Over a period of approximately 50 minutes, the temperature of the mixture was raised to a reaction temperature of approximately 170° C. under a nitrogen atmosphere. A sample of the mixture was removed and the concentration of PCBs in the sample was measured to be 14,400 mg/kg (equivalent to 6.5% of PCB in the feed material). 10 g of sodium dispersion (40% sodium in insulating oil) in 10 g of VARSOL™ solvent was added to the mixture and allowed to react with the mixture while the temperature of the mixture was maintained near 170° C. A sample of the mixture was removed after approximately 5 minutes after the addition of the sodium dispersion, and the concentration of PCBs in the sample was measured to be 1,910 mg/kg. Another sample of the mixture was removed after approximately 15 minutes after the addition of the sodium dispersion, and the concentration of PCBs in the sample was measured to be 78 mg/kg. Another sample of the mixture was removed after approximately 90 minutes after the addition of the sodium dispersion, and the concentration of PCBs in the sample was measured to be below the detection limit. The mixture was then allowed to cool, and at below 100° C., 3 g of water was added to the mixture.

EXAMPLE 4

80 g of crushed potting compound and 20 g of crushed capacitor windings, having average particle sizes of less than ½" in size, were placed into a 500 mL glass reaction vessel fitted with a water cooled condenser, an inlet for nitrogen gas and an inlet for a dropping funnel. 390 g of the solvent ISOPAR K™ was placed into the reaction vessel, and the mixture was agitated using a variable speed mechanical stirrer. Over a period of 30 minutes, the temperature of the mixture was raised to a reaction temperature of approximately 160° C. under a nitrogen atmosphere. A sample of the mixture was removed and the concentration of PCBs in the sample was measured to be approximately 14,400 mg/kg (equivalent to 6.5% of PCB in the feed material). 10 g of sodium dispersion (40% sodium in insulating oil) in 10 g of VARSOL™ solvent was added to the mixture and allowed to react with the mixture while the temperature of the mixture was raised slightly to 170° C. and maintained at this level. Another sample of the mixture was removed after approximately 30minutes and again at 60 minutes after the addition of the sodium dispersion, and the concentration of PCBs in each case was measured to be below the detection limit. The mixture was then allowed to cool, and at below 100° C., 3 g of water was added to the mixture.

EXAMPLE 5

80 g of crushed potting compound and 20 g of crushed capacitor windings, having average particle sizes of less than ½" in size, were placed into a 750 mL glass reaction vessel fitted with a water cooled condenser, an inlet for nitrogen gas and an inlet for a dropping funnel. 390 g of the solvent ISOPAR K™ was placed into the reaction vessel, and the mixture was agitated using a variable speed mechanical stirrer. The temperature of the mixture was raised to a reaction temperature of approximately 170° C. under a nitrogen atmosphere. A sample of the mixture was removed and the concentration of PCBs in the sample was measured to be approximately 14,300 mg/kg (equivalent to 6.5% of PCB in the feed material). 10 g of sodium dispersion (40% sodium in insulating oil) in 10 g of ISOPAR K™ solvent was added to the mixture and allowed to react with the mixture while the temperature of the mixture was maintained at the reaction temperature. Another sample of the mixture was removed after approximately 30 minutes and again at 60 minutes after the addition of the sodium dispersion, and the concentration of PCBs in each case was measured to be below the detection limit. The mixture was then allowed to cool, and at below 100° C., 3 g of water was added to the mixture.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. In the specification, the word "comprising" is used as an open-ended term, substantially equivalent to the phrase "including, but not limited to", and the word "comprises" has a corresponding meaning. Citation of references herein shall not be construed as an admission that such references are prior art to the present invention. All publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples.

What is claimed is:

1. A process for destruction of organic halides in an asphaltic waste, comprising:

crushing a solid asphaltic waste containing an organic halide to provide an asphaltic waste containing the organic halide for treatment, the crushing being carried out at a crushing temperature that is below a melting temperature of the solid asphaltic waste;

mixing the asphaltic waste with a solvent to produce a waste-solvent mixture;

heating the waste-solvent mixture to a dissolving temperature for a dissolving time to produce a heated waste-solvent mixture in which the asphaltic waste is dissolved in the solvent so that the organic halide is released from the asphaltic waste;

adding a metallic alkali metal destructive reactant to the heated waste-solvent mixture at a reaction temperature for a reaction time to produce a treated waste-solvent mixture in which the organic halide is substantially all reacted with the destructive reactant to destroy the organic halide; and distilling the treated waste-solvent mixture to separate the solvent from the asphaltic waste to produce a recyclable solvent substantially free of asphaltic waste and reusing the recyclable solvent as the solvent in the mixing of the asphaltic waste with the solvent to produce the waste-solvent mixture.

2. The process of claim 1, wherein the organic halide is a PCB.

3. The process of claim 1, wherein the solvent is a hydrocarbon solvent.

4. The process of claim 2, wherein the solvent is a hydrocarbon solvent.

5. The process of claim 1, wherein the reactant is in a dispersion.

6. The process of claim 2, wherein the reactant is in a dispersion.

7. The process of claim 3, wherein the reactant is in a dispersion.

8. The process of claim 4, wherein the reactant is in a dispersion.

9. The process of claim 8, wherein the reactant is sodium.

10. The process of claim 1, wherein the asphaltic waste is a potting compound.

11. The process of claim 1, wherein the organic halide has an organic halide boiling point, and the dissolving temperature and the reaction temperature are below the organic halide boiling point.

12. The process of claim 9, further comprising adding a hydrolyzing reactant to the treat waste-solvent mixture to hydrolyse an excess amount of alkali metal remaining in the treated waste-solvent mixture.

13. The process of claim 12, wherein the hydrolyzing reactant is water.

14. The process of claim 8, wherein the dispersion comprises an alkali metal solvent.

15. The process of claim 10, wherein the potting compound encases an electrical component, and the electrical component is treated in the process of the invention with the potting compound.

16. The process of claim 15 wherein the electrical component is a capacitor.

17. A process for destruction of PCBs in a solid asphaltic potting compound waste, comprising:

crushing a solid asphaltic potting compound waste containing a PCB to provide an asphaltic potting compound waste containing the PCB for treatment, the crushing being carried out at a crushing temperature that is below a melting temperature of the solid asphaltic potting compound waste;

mixing the asphaltic potting compound waste with a hydrocarbon solvent to produce a waste-solvent mixture;

heating the waste-solvent mixture to a dissolving temperature for a dissolving time to produce a heated waste-solvent mixture in which the asphaltic potting compound waste is dissolved in the hydrocarbon solvent so that the PCB is released from the asphaltic potting compound waste;

adding a metallic sodium metal destructive reactant to the heated waste-solvent mixture at a reaction temperature for a reaction time to produce a treated waste-solvent mixture in which the PCB is substantially all reacted with the sodium metal destructive reactant to destroy the PCB;

distilling the treated waste-solvent mixture to separate the solvent from the asphaltic potting compound waste to produce a recyclable solvent substantially free of asphaltic waste; and reusing the recyclable solvent as the solvent in the mixing of the asphaltic waste with the solvent to produce the waste-solvent mixture.

18. An apparatus for carrying out a process for destruction of organic halides in a solid asphaltic waste, comprising:

means for crushing a solid asphaltic waste containing an organic halide at a crushing temperature that is below a melting temperature of the solid asphaltic waste so as to provide an asphaltic waste containing the organic halide for treatment;

means for mixing the asphaltic waste with a solvent to produce a waste-solvent mixture;

means for heating the waste-solvent mixture to a dissolving temperature for a dissolving time to produce a heated waste-solvent mixture in which the asphaltic waste is dissolved in the solvent so that the organic halide is released from the asphaltic waste;

means for adding a metallic alkali metal destructive reactant to the heated waste-solvent;

mixture at a reaction temperature for a reaction time to produce a treated waste-solvent mixture in which the organic halide is substantially all reacted with the destructive reactant to destroy the organic halide;

means for distilling the treated waste-solvent mixture to separate the solvent from the asphaltic waste to produce a recyclable solvent substantially free of asphaltic waste; and means for reusing the recyclable solvent as the solvent in the means for mixing the asphaltic waste with the solvent to produce the waste-solvent mixture.

19. The process of anyone of claims 5 to 8, 9, 12 to 14 and 17, further including adding a hydrogen donor or promoter to the heated waste-solvent mixture at the time when the destructive reactant is added to said heated waste-solvent mixture.

20. The process of claim 19 wherein the hydrogen donor or promoter is selected from the group consisting of water, an alcohol and an acid.

* * * * *